United States Patent [19]

Wallis

[11] 4,339,976

[45] Jul. 20, 1982

[54] PUNCH RETAINER

[76] Inventor: Bernard J. Wallis, 25200 Trowbridge Ave., Dearborn, Mich. 48124

[21] Appl. No.: 177,117

[22] Filed: Aug. 11, 1980

[51] Int. Cl.[3] ..... B26D 7/26; B26F 1/14

[52] U.S. Cl. ..... 83/684; 83/686; 83/698; 83/700; 279/97; 279/1 K

[58] Field of Search ..... 279/87, 93, 97, 1 K; 83/684, 685, 686, 698, 700

[56] References Cited

U.S. PATENT DOCUMENTS

| | | | |
|---|---|---|---|
| 2,767,990 | 10/1956 | Jewell, Jr. | 83/698 |
| 3,152,654 | 10/1964 | Conover | 279/97 |
| 3,535,967 | 10/1970 | Whistler, Sr. | 83/698 |
| 3,997,989 | 12/1976 | Stepe | 279/97 |
| 4,174,648 | 11/1979 | Wallis | 83/698 |

FOREIGN PATENT DOCUMENTS

| | | | |
|---|---|---|---|
| 1119476 | 12/1961 | Fed. Rep. of Germany | 83/698 |
| 1172851 | 12/1969 | United Kingdom | 83/698 |

*Primary Examiner*—James M. Meister
*Assistant Examiner*—K. Bradford Adolphson
*Attorney, Agent, or Firm*—Barnes, Kisselle, Raisch & Choate

[57] ABSTRACT

A punch and retainer assembly wherein the punch has a non-circular punching end, a flattened surface at the upper end of the side wall thereof and a radially inwardly extending recess directly below the flattened side wall portion. The punch retainer includes a vertically movable latch adapted to engage within the recess on the shank of the punch and retain the punch within the retainer. Means are provided for limiting vertical movement of the latch so that the punch can be inserted into the retainer only when the flattened surface thereof is aligned parallel with the pivot axis of the punch. Spring means are also provided for maintaining the non-circular punching end of the punch in a predetermined circumferential angular relationship relative to the latch.

2 Claims, 9 Drawing Figures

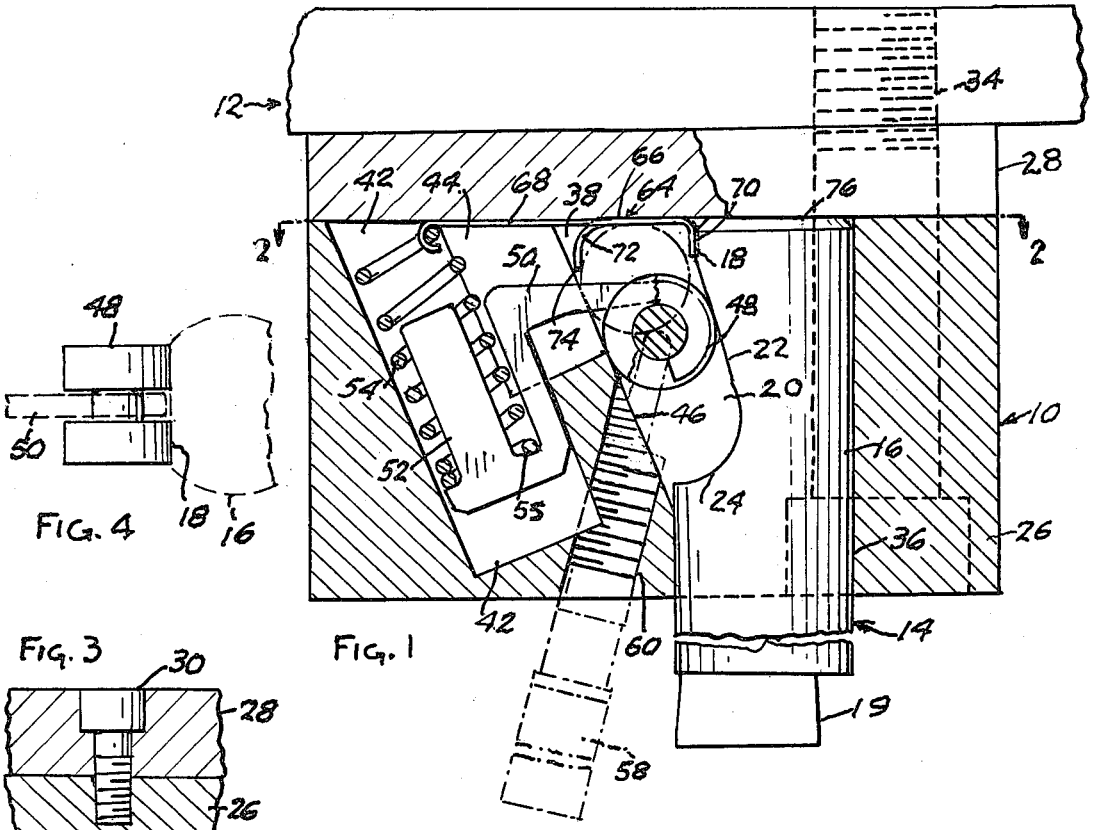
FIG. 1
FIG. 4
FIG. 3
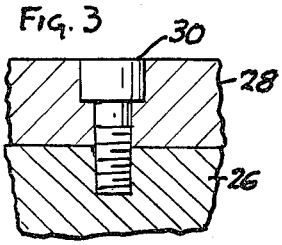
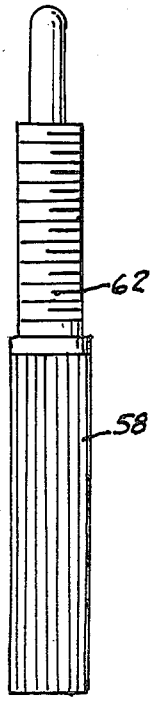
FIG. 5
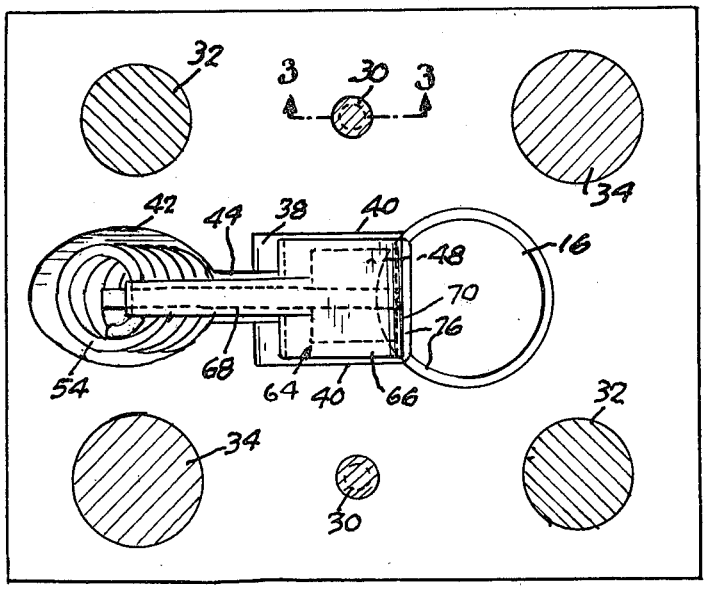
FIG. 2

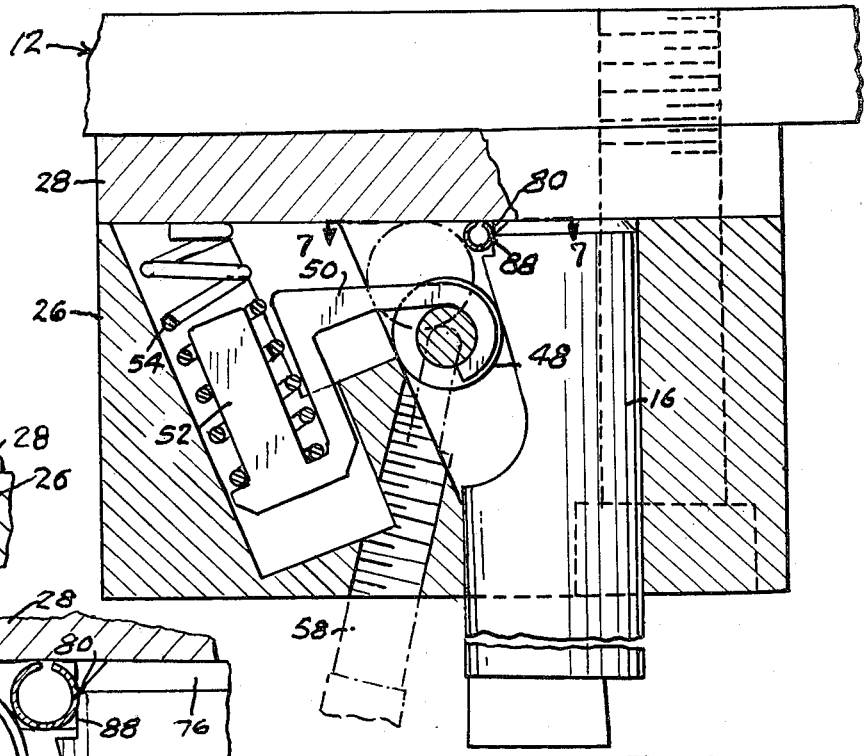
FIG. 6
FIG. 9
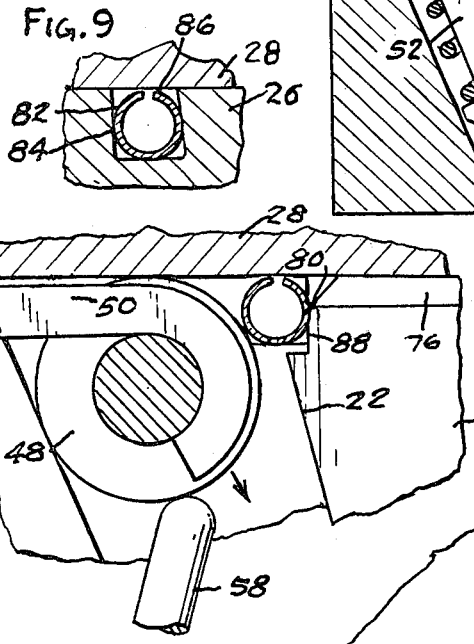
FIG. 8
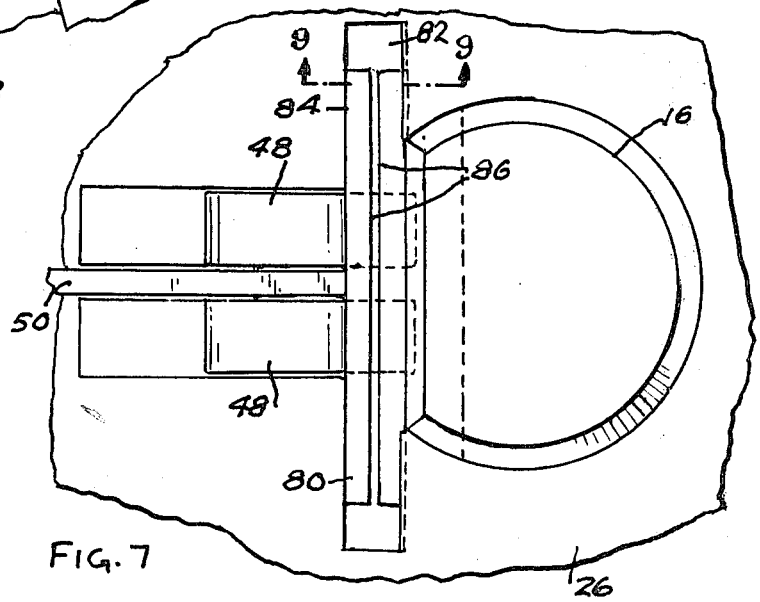
FIG. 7

PUNCH RETAINER

BACKGROUND AND SUMMARY OF THE INVENTION

This invention relates to a punch retainer for use on stamping presses and, more particularly, to a punch retainer generally of the type disclosed in my U.S. Pat. No. 4,174,648, dated Nov. 20, 1979. In my aforesaid patent there is disclosed a punch retainer provided with a latch having cylindrically shaped opposite sides which are adapted to tangentially engage in wedging relationship an inclined face on the punch and an inclined face of a socket within the punch retainer. The latch is urged into said tangential wedging engagement with the punch and the inclined wall of the socket by means of a spring. While the arrangement shown in said patent is admirably suited for use with punches having a circular punching end, experience has shown that where the punch is provided with a non-circular punching end the dimensional tolerances of the cooperating surfaces on the punch, the latch and the retainer are critical and must be closely controlled if the punched hole has to be within very close tolerances. Unless such tolerances are closely controlled, the punch might be firmly seated within the socket but the punching end thereof may be rotated at least slightly from its desired accurately oriented position.

The primary object of the present invention is to provide a simple mechanism for firmly retaining a punch within a retainer so that the non-circular punching end of the punch is accurately oriented in a circumferential sense relative to the retainer.

A more specific object of the invention resides in the provision of a spring housed within the retainer for engaging a flat surface on the punch which is accurately machined relative to the non-circular punching end of the punch.

BRIEF DESCRIPTION OF THE DRAWINGS

Other objects, features and advantages of the present invention will become apparent from the following description and accompanying drawings, in which:

FIG. 1 is a vertical sectional view through a punch and retainer according to the present invention;

FIG. 2 is a sectional view along the line 2—2 in FIG. 1;

FIG. 3 is a fragmentary sectional view along the line 3—3 in FIG. 2;

FIG. 4 is a fragmentary view illustrating generally the manner in which the latch engages the punch;

FIG. 5 is an elevational view of the tool employed for displacing the latch to the punch release position;

FIG. 6 is a view similar to FIG. 1 and showing a modified form of the invention;

FIG. 7 is a sectional view on an enlarged scale along the line 7—7 in FIG. 6;

FIG. 8 is a fragmentary sectional view of a portion of the arrangement shown in FIG. 6 illustrating the manner in which the latch is displaced to the punch releasing position; and FIG. 9 is a fragmentary sectional view along the line 9—9 in FIG. 7.

DETAILED DESCRIPTION OF THE PREFERRED EMBODIMENTS

In FIG. 1 there is shown a punch retainer block 10 mounted on an upper reciprocating die shoe 12 and having a punch 14 retained in block 10. Punch 14 has a generally cylindrical shank 16, the side wall of which is ground with a flat 18 adjacent the upper end of the punch. The lower end of the punch is provided with a non-circular punching portion 19. A recess 20 is formed in the side wall of the punch directly below the flat 18. Recess 20 preferably comprises a flat inwardly inclined face 22, the lower end of which is tangent to an outwardly curved face 24.

Retainer block 10 comprises a lower body portion 26 and an upper cap plate 28 which are secured together by screws 30 (FIG. 3). Retainer block 10 is accurately located on die shoe 12 by dowel pins 32 and firmly secured thereto by screws 34.

Body 26 of retainer block 10 is formed with an accurately cylindrical bore 36 adapted to snugly receive the shank 16 of punch 14. At one side of bore 36 body 26 is formed with a socket 38 extending downwardly from the top face thereof. The portion of socket 38 which intersects bore 36 is defined by two parallel, vertically extending, side walls 40. The laterally outer end portion of socket 38 is enlarged as at 42 and connected to the portion defined by side walls 40 by a narrow slot 44. The laterally outer side wall 46 of socket 38 which is intersected by slot 44 is inclined so that it converges slightly with respect to the inclined face 22 on punch 14. For example, face 22 may be inclined to the vertical at an angle of about 15° and the face 46 may be inclined to the vertical at an angle of about $22\frac{1}{2}°$ so that the included angle therebetween is about $7\frac{1}{2}°$.

The means for retaining punch 14 seated in block 10 comprises a cylindrical roller 48 supported within socket 38 by a yoke 50. As shown in FIG. 1, yoke 50 extends around a central groove in cylinder 48, laterally outwardly through slot 44 and into the enlarged cylindrical portion 42. The portion of yoke 50 within the enlarged portion 42 is generally U-shaped and formed with an upstanding leg 52 which serves as a retainer for a compression spring 54. The lower end of spring 54 is seated on the return bend portion 55 of yoke 50 and the upper end of spring 54 abuts against the under side of cap plate 28. Spring 54, acting through yoke 50, normally biases roller 48 downwardly in socket 38. In its uppermost position, wherein roller 48 abuts against the bottom face of cap plate 28 (the broken line position shown in FIG. 1), roller 48 projects into bore 36 and just clears the flat 18 at the upper end of the punch when the punch is circumferentially oriented so that the flat 18 is parallel to the axis of roller 48.

When the punch is seated in bore 36 in the position shown in FIG. 1 it may be removed therefrom by advancing a tool 58 upwardly through a bore 60 in body 26 to displace roller 48 upwardly out of recess 20 against the bias of spring 54 to the broken line position. As a matter of convenience tool 58 is threaded as at 62 and bore 60 is threaded so that the roller 48 can be advanced to the broken line position by threading tool 58 upwardly and retained in its raised position by the threaded connection between tool 58 and bore 60. In this position roller 48 just clears the flat 18 on the punch and enables the punch to be withdrawn from bore 36. When tool 58 is threaded out of bore 60 roller 48 will assume the approximate position shown in FIG. 1 under the bias of spring 54.

When it is desired to insert the punch in the retainer, the punch is pushed upwardly into bore 36 with the flat 18 aligned generally parallel with the axis of roller 48.

The upper edge of flat 18 engages roller 48 and displaces it upwardly and inwardly of socket 38, which movement is permitted by spring 54. As the shank of the punch is moved progressively upwardly in socket 36 and after roller 48 clears flat 18, spring 54 displaces roller 48 downwardly progressively until the upper end of the punch is seated against the cap plate 28. At this time, one side of roller 48 tangentially engages the flat inclined face 22 on the punch with line contact. The opposite side of roller 48 is in tangential line contact with the flat wall 46 of socket 38. Roller 48 is thus engaged in wedging relation between punch 14 and the inclined face 46 of the socket 38 in the retainer body.

The present invention is directed specifically to the means for automatically rotating the punch 14 slightly, if necessary, so that, when it is fully seated in retainer 10, the flat 18 is parallel to a high degree of accuracy to the line of intersection between a horizontal plane and the inclined face 46 of socket 38. These means are in the form of a spring 64. As shown in FIGS. 1 and 2, spring 64 includes a body portion 66 having a lateral extension 68 extending through slot 44 and hooked over one of the coils of spring 54. At its opposite end spring 64 has a downwardly bent leg 70 adapted to engage the flat 18 and adjacent the extension 68 the spring is provided with a pair of downwardly bent legs 72 having straight lower edges 74 which engage the inclined face 46 of socket 38 on the opposite sides of slot 44. Leg 70 is bent downwardly from the body portion of spring 64 at a much sharper angle than legs 72. Thus, legs 72 are substantially more flexible than leg 70. The lower edges of legs 72 are accurately parallel to the leg 70 of spring 64 and remain accurately parallel thereto when the legs 72 are flexed.

In the free condition of spring 64 the lateral spacing between legs 72 and leg 70 is such that the leg 70 extends into bore 36 a slight distance beyond flat 18. However, the upper end of punch 14 is chamfered as at 76 so that when the punch is inserted upwardly in bore 36 chamfer 76 engages the lower end of leg 70 which aligns the flat 18 on the punch accurately parallel to the edge 74 of spring 64. Thereafter, when the punch is advanced upwardly to its fully seated position shown in FIG. 1, the spring legs 72 are flexed inwardly toward the punch axis by the inclined surface 46 so that the non-circular punch end 19 is oriented circumferentially in a predetermined position relative to the retainer to a high degree of accuracy. In the absence of a mechanism such as spring 64, punch 14 could be fully seated within the retainer with roller 48 in a slightly cocked condition, in which event the punching end 19 would not be oriented to a high degree of accuracy in the desired position relative to the retainer.

The arrangement shown in FIGS. 6 through 9 is the same as in the previously described embodiment with the exception of the means for retaining the punch in the predetermined accurately oriented position relative to the retainer. In this embodiment these means comprise a circumferentially resilient roll pin 80 which is seated in a slot 82 at the upper end of socket 38. The laterally outer face 84 of slot 82 is accurately parallel to the line of intersection between a horizontal plane and the inclined face 46. Roll pin 80 is in the form of a tubular member formed of spring material having spaced apart edges 86. Slot 82 and pin 80 are dimensioned and located such that, when the pin 80 is seated in slot 82, the laterally inner side thereof projects inwardly of bore 36 slightly beyond the square notch 88 at the upper end of the punch. Thus, in a manner similar to that described with reference to the previous embodiment, when the punch is fully inserted into bore 36, pin 80 properly aligns the punch and is compressed between the outer wall 84 of slot 82 and notch 88 so as to maintain the punch in the desired position with respect to the orientation of the punch end 19 relative to the retainer.

It will therefore be seen that the spring retainers 64,80 assure the proper orientation of the punch to a high degree of accuracy. These retainers eliminate the necessity for a very high degree of dimensional accuracy of the interengaging surfaces between the punch, roller 48 and the inclined face 46 of socket 38. At the same time, it will be appreciated that the manufacture of spring 64 or pin 80 to a high degree of accuracy and inexpensively does not pose any serious manufacturing problems.

I claim:

1. In combination a punch having a shank of circular cross section and provided with a punching end of non-circular cross section at its lower end, said shank having an indented side wall portion, a punch retainer having a vertically extending circular bore sized to receive said shank and abutment means against which the upper end of the shank is adapted to bottom when the punch is fully inserted in said bore, said retainer also having a socket therein opening radially into said bore, latch means in said socket resiliently engaging said indented side wall portion of the shank for releasably retaining the punch in said retainer with the upper end thereof engaging said abutment means, said shank having a flat side wall portion, said flat side wall portion having a predetermined circumferential angular relationship to said non-circular punching end, said retainer having a recess therein adjacent the upper end of said bore opening at one side thereof into said bore and provided at the opposite side thereof with a flat abutment face spaced radially from and lying in a plane extending transversely of the central vertical axis of said bore, a leaf spring in said recess having a central body portion and legs at opposite ends bent out of the plane of the central body portion, the free ends of said legs comprising parallel straight edges resiliently engaging the flat side wall of the punch shank and the abutment face of the recess, respectively, said free edges being resiliently displaceable toward each other, the upper end of the punch and the leg of the spring adjacent thereto being shaped such that when the punch is displaced upwardly with its flat side wall aligned generally parallel with said last-mentioned leg of the spring, said leg resiliently engages the flat side wall of the punch and rotates the punch to a position wherein the flat side wall portion is accurately parallel to the free edge of the other leg of the spring.

2. The combination called for in claim 1 wherein one of said legs is bent out of the plane of said body portion at a substantially greater radius than the other to render said one leg more readily flexible than the other.

* * * * *